United States Patent [19]

Arbouw

[11] Patent Number: 4,953,451

[45] Date of Patent: Sep. 4, 1990

[54] VENTILATION DEVICE

[75] Inventor: Willem D. Arbouw, Harderwijk, Netherlands

[73] Assignee: Aluart Aluminum B.V., Nieuwegein, Netherlands

[21] Appl. No.: 431,091

[22] Filed: Nov. 3, 1989

[30] Foreign Application Priority Data

Nov. 8, 1988 [NL] Netherlands ..... 8802740

[51] Int. Cl.[5] ..... E06B 7/02

[52] U.S. Cl. ..... 98/98

[58] Field of Search ..... 98/88.1, 98, 99.01, 98/99.6, 99.8, 100.5

[56] References Cited

FOREIGN PATENT DOCUMENTS 115824 8/1984 European Pat. Off. .
1151910 7/1963 Fed. Rep. of Germany ..... 98/88.1
1454613 2/1969 Fed. Rep. of Germany ..... 98/99.01
2942482 4/1981 Fed. Rep. of Germany ..... 98/88.1
3005800 8/1981 Fed. Rep. of Germany ..... 98/99.8
2298671 8/1976 France .
2517354 6/1983 France .
8201592 11/1983 Netherlands .
1433405 4/1976 United Kingdom ..... 98/88.1

*Primary Examiner*—Harold Joyce
*Attorney, Agent, or Firm*—Edmund M. Jaskiewicz

[57] ABSTRACT

Ventilation device with a rectangular frame of which each of the upright sides is formed by an end part, the bottom is formed by a glass holder adapted to the thickness of a glass panel, and the top is formed by a profiled L-shaped strip of which the horizontal leg facing the room defines with an edge projecting from the upright leg an accommodation space into which fits the horizontal leg of an inverted T-section with off-center upright leg.

9 Claims, 5 Drawing Sheets

VENTILATION DEVICE

BACKGROUND OF THE INVENTION

The invention relates to a ventilation device with a rectangular frame containing a shut-off element, such as known in practice.

Both in modern building and in renovation projects, in particular when double glazing is used, different thicknesses of glass are used, and in the state of the art a suitable device must be designed for each thickness of glass. This means that a large number of ready devices of different types, suitable for different thicknesses of glass panels, always have to be kept in stock, which means, of course, a considerable investment, also in storage space.

SUMMARY OF THE INVENTION

The object of the invention is to produce a ventilation device which can be adapted in a particularly simple manner to all situations which occurring in practice, and in particular to the thickness of the glass panel. Another object is to produce a ventilation device which is largely made up of standard parts and has as few parts as possible which are usable for only one particular thickness of glass panel.

This object is achieved according to the invention in that each of the upright sides of the frame is formed by an end part, the bottom side is formed by a glass holder which is fitted between the end parts and is adapted to the thickness of the glass panel, and the upper side of the frame is formed by a profiled strip which is L-shaped in cross-section and is also fitted between the end parts, and of which the horizontal leg facing the room to be ventilated continues at the free end thereof into an upright edge which merges into an end edge which faces the upright leg and is situated opposite an edge projecting at right angles from the upright leg, in such a way that an accommodation space is formed, into which fits the horizontal leg of an inverted profiled T-section whose upright leg lies outside the center of the horizontal leg.

Preferably the upright leg of the upper profiled strip is connected by means of a connecting piece to an outermost profiled strip which runs parallel thereto and continues into a water barrier covering the device at least partially on the outside.

In an advantageous embodiment each end part is made up of a housing whose inner boundary facing the inside of the device connects to the contours of the L-shaped strip and water barrier and those of the outermost or horizontal part of the glass holder, and an adjustable L-shaped shut-off part which is to be connected to the outside wall of said housing, and which has on the top or bottom side a shut-off lip which connects at one side to the upright leg of the T-section and at the other to the inner leg of the glass holder.

In a preferred embodiment the space bounded by the insides of the end parts, the in- side wall of the glass holder and the inside wall of the L-shaped strip is designed to take a detachable insert forming an independent structural component.

DESCRIPTION OF THE DRAWINGS

FIG. 1 is a perspective view of the ventilation grille according to the invention with two different grille units to be placed as an insert inside the frame;

DESCRIPTION OF A PREFERRED EMBODIMENT

Figure 7:
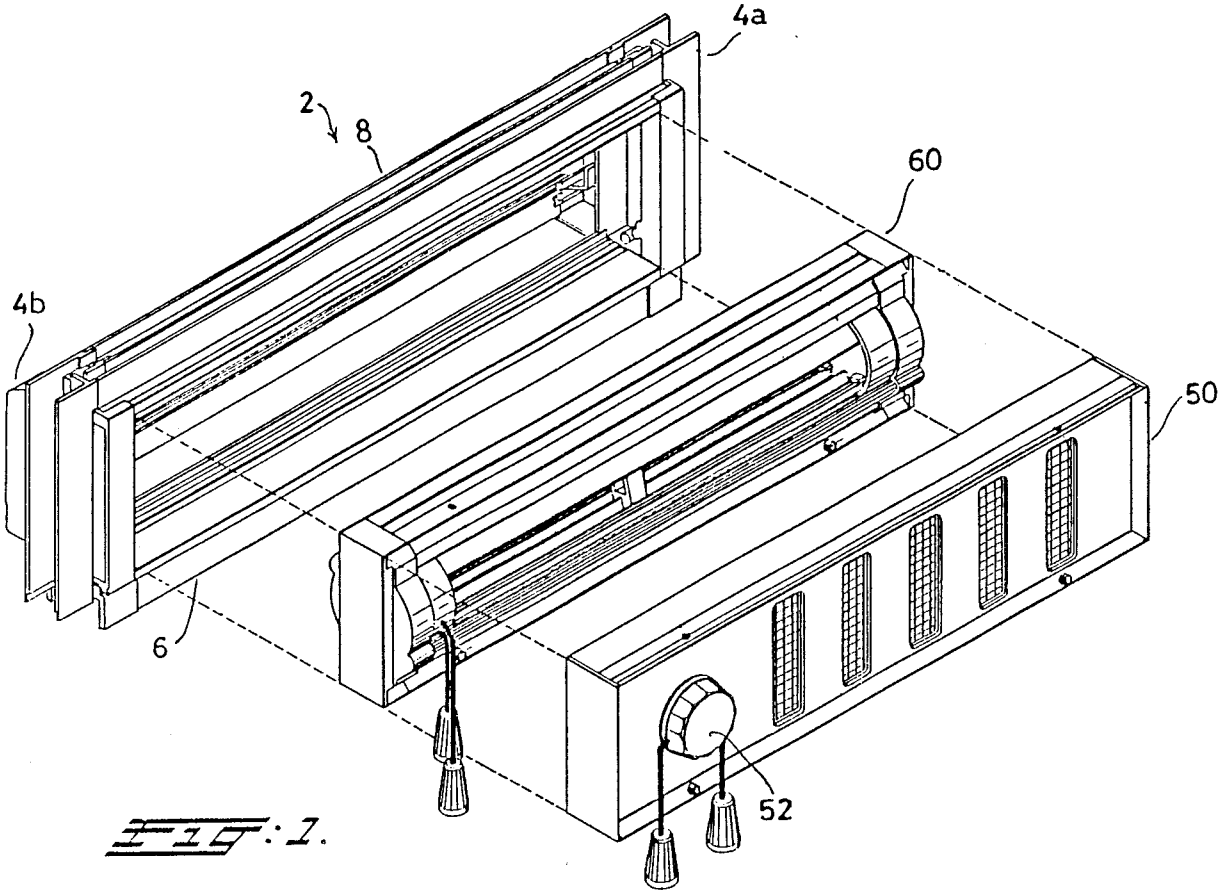
Figure 2A:
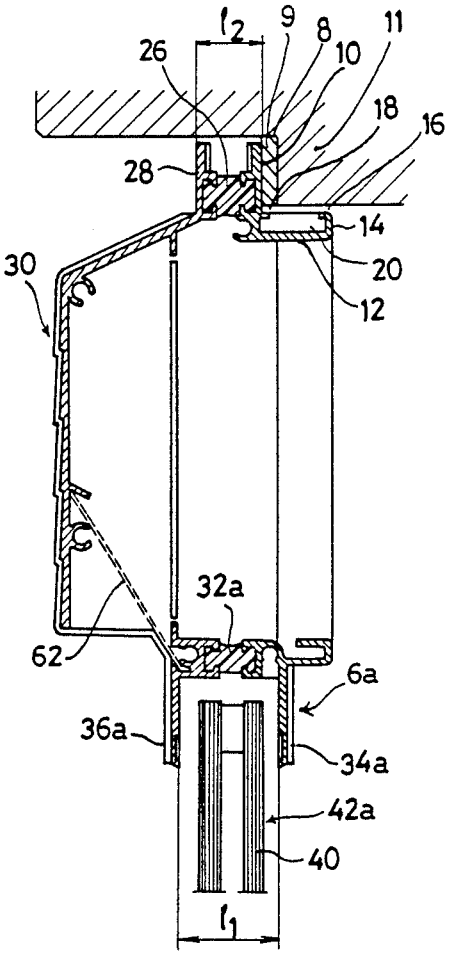
FIGS. 2*a*, 2*b*, 2*c* and 2*d* are cross-sections through the frame of this ventilation grille to illustrate the advantage to be achieved with the measures according to the invention.
Figure 2B:
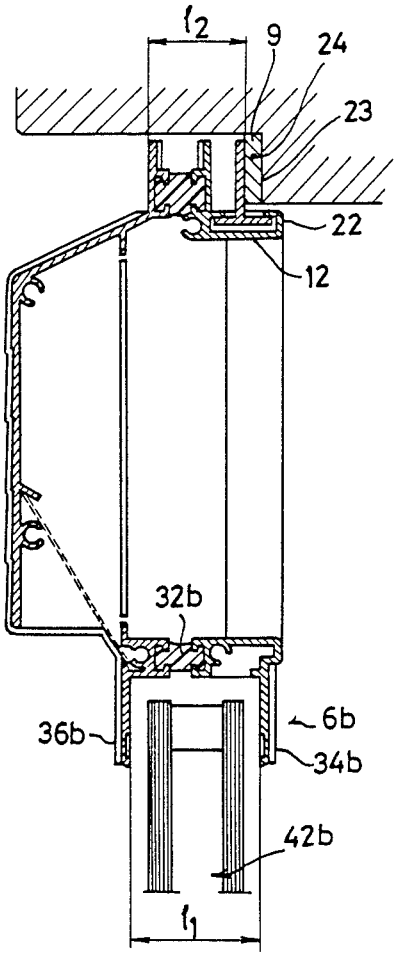

The ventilation device according to the invention comprises a retangular frame which is indicated in its entirety by reference numeral 2 in FIG. 1, and of which the upright sides are formed by the end parts 4*a*, 4*b* yet to be described, the bottom side is formed by a glass holder 6 (which is adapted to the thickness of the glass in which the ventilation device is being used) disposed between these end parts 4*a* and 4*b*, while the top side is formed by a specially shaped profiled strip 8 which rests by means of the putty strip 9 against the rebate 11. This strip 8, which is shown in cross-section in FIGS. 2*a*–2*d* and in FIG. 3, is designed in a special way. The strip 8 is L-shaped in cross-section, with an upright leg 10, and connected thereto a horizontal leg 12 facing the area to be ventilated. The horizontal leg 12 continues in an upward directed part 14 which ends in a flanged end edge 16; opposite this flanged end edge lies an edge 18 which extends from the upright leg 10. Thus a chamber 20 which serves to accommodate the horizontal leg 22 of an inverted T-section 21, whose vertical leg 24 is directed upwards, is formed - see FIGS. 2*b*–2*d* and 3. This vertical leg 24 lies off-center relative to the center line 25 of the horizontal leg 22 (see FIG. 3).

The upright leg 10 is connected by means of a connecting piece 26 forming a thermal barrier to the upright edge 28 of the water barrier 30 usual for ventilation devices of the present type. The specific design thereof is not a subject of the application, and will therefore not be discussed any further.

The object of the invention is to make a ventilation device of the present type by simple means, suitable for use with different thicknesses of glass and in different building environments, in such a way that the minimum of parts, determined by the building environment, will suffice, so that it is possible to work largely with standard parts. One of the parts which has to be adapted to the circumstances is the glass holder 6 (see FIG. 4), of which FIGS. 2*a*–2*d* show different forms in cross-section, denoted by 6*a*, 6*b*, 6*c* and 6*d* respectively. All embodiments have in common the fact that they are made up of two sections joined together by means of a thermal barrier 32 each section with a downward facing strip part 34*a*–34*d* and 36*a*–36*d* respectively, the respective spacings between which may differ.

FIG. 2 shows the situation in which the ventilation device according to the invention is used with a glass panel 14 mm thick, where the distance $l_1$ between the inner faces of the strips 34*a*–36*a* must be equal to 22 mm, and the distance $l_2$ between the outsides of the strips 10 and 28 must be equal to 14 mm. This means that the strip 28 lies 14 mm away from the outer face 38 of the rebate, while this outer face of the rebate is in line with the inner face 40 of the glass panel 42*b* whose thickness is, as stated, 14 mm.

With a glass panel 42*a* which is 21 mm thick the distance $1_1$ must be equal to 29 mm, and the distance $1_2$ equal to 21 mm. A ventilation device to be adapted to these circumstances merely requires a different glass holder 6*b* in which the distance $1_1$ is 29 mm. The distance $1_2$ is obtained by placing the horizontal leg 22 of the section 23 in the chamber 20, in such a way that said leg 22 lies left of the center 25. The distance $1_2$ can be made 21 mm by a correct selection of the dimensions of the horizontal leg and the distance between the leg 24 and said center 25 of the leg 24. This situation is shown on an enlarged scale in FIG. 3, which is reverted to in greater detail below.

Figure 2C:
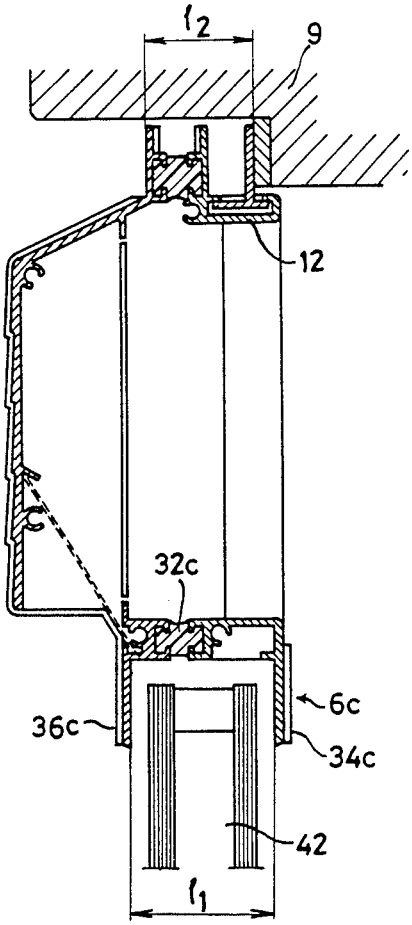
Figure 2D:
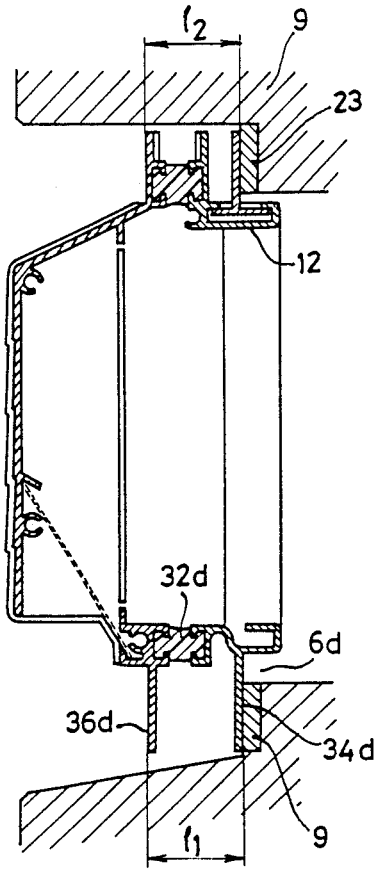
Figure 3:
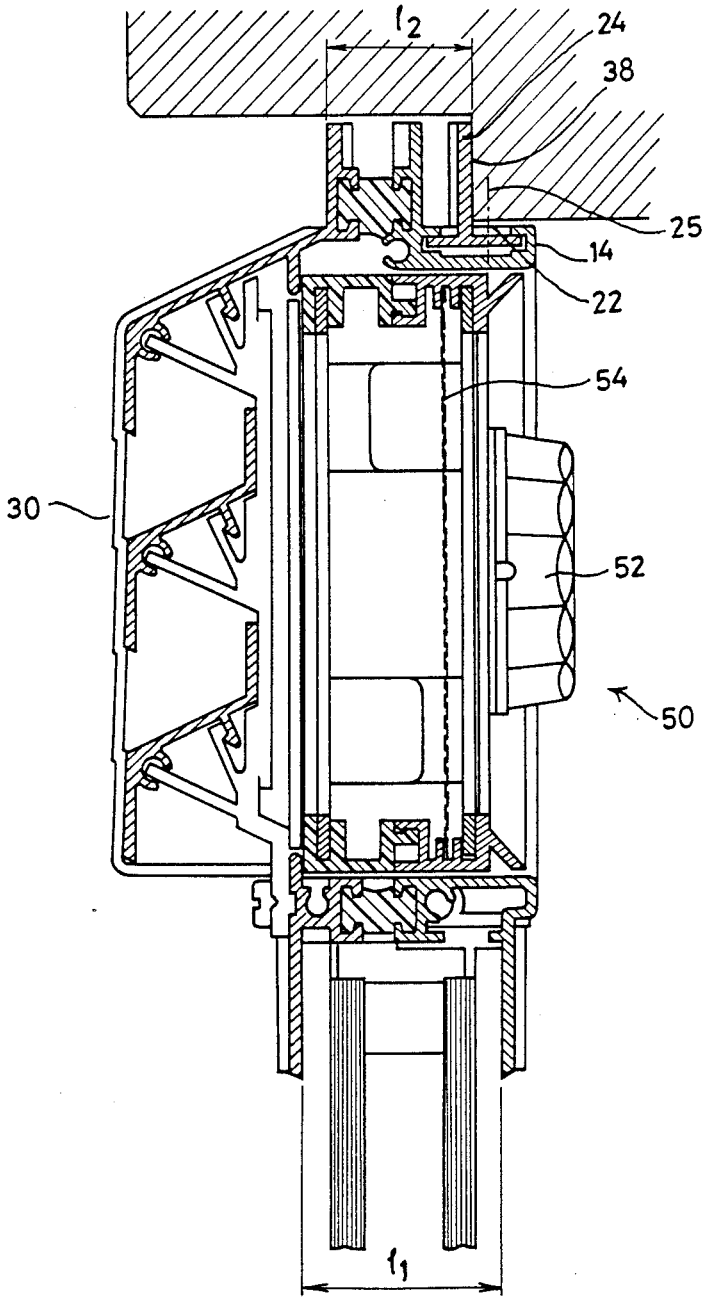
FIG. 3 is a cross-section corresponding to FIG. 2*b*, showing a slightly differently designed sliding grille unit.

FIG. 2*c* shows the situation which arises if one wishes to use a glass panel 42*c* which is 24 mm thick, in which case the distance $1_1$ from the glass holder will have to be 32 mm and the distance $1_2$ has to be 24 mm. This latter situation is achieved by placing the section 23 "the other way round" in the chamber 20 with a glass holder with a distance $1_1$ which is equal to 32 mm.

Finally, the ventilation device according to the invention can also be designed for placing in a lintel, in which case the distance $1_1$ must be 21 mm and the distance $1_2$ also has to be 21 mm. The section 23 is then placed in the manner as shown in FIG. 2*b*, and a section 6*d* is used whose distance $1_1$ is 21 mm.

Figure 4:
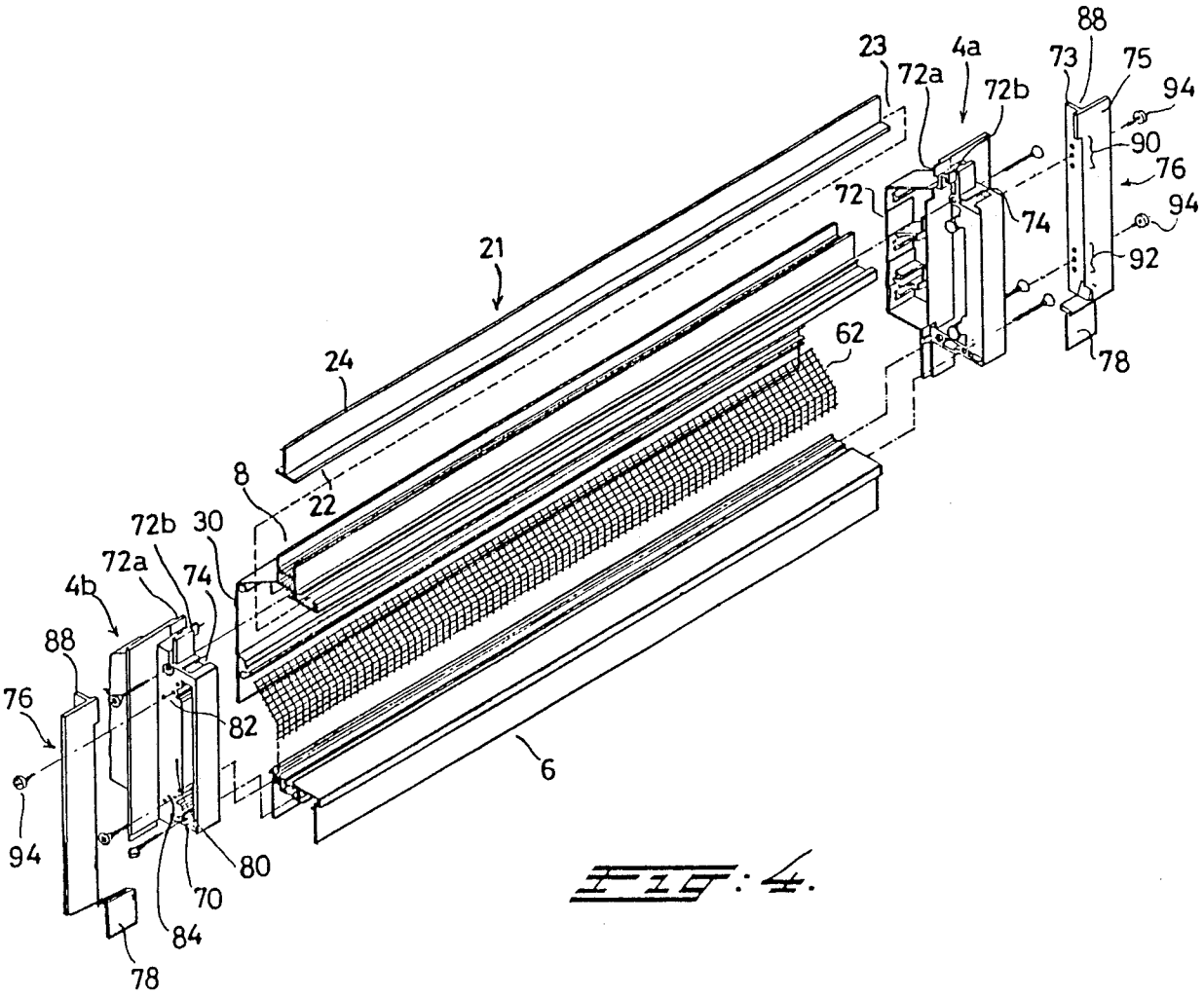
FIG. 4 is a perspective view of the frame used in the ventilation grille according to the invention, in disassembled form.

FIG. 3 (in which the putty strip 9 is not shown, for the sake of clarity) shows how a ventilation device unit 50 can be placed inside the space determined by the two end parts, the bottom face of the leg 12 and the top faces of the section parts from the glass holder, said ventilation device unit in this case being a sliding ventilation unit of the type known per se, with a control button 52 and a wire mesh grille 54. However, a different ventilation unit can also be used in this space, for example a rotary ventilation unit 60 as shown in FIG. 1. The actual structure of these ventilation device units is not a subject of the application and will therefore not be explained in further detail.

Where such a rotary ventilation unit is used and there is no screening mesh present in the ventilation unit itself, this mesh can be fitted in the water barrier 30, as indicated by 62 in FIGS. 2*a*–2*d* and in FIG. 4.

As already said, a complete ventilation device is closed at both ends by an end part 4*a*, 4*b*. Shape and dimensions of such an end part must, of course, be adapted to the top and bottom strip of the frame used. Each such end part comprises according to the invention a housing of which the front edge boundary 72 is adapted to the contours of the water barrier 30, while the two projecting lips 72*a*, 72*b* at the top side of the housing fit between the ribs 10 and 28 which are at a fixed distance from each other. Next to these lips is the chamber 74 which corresponds to the chamber 20, and into which the left and right end of the section 23 fits. The inner boundary of each end part must be adapted to the distance $1_2$, and this is achieved by a closure part 76 which is made up of two faces 73 and 75 lying at right angles to each other, and which is provided with a lip-shaped face 78 which projects inwards and downwards, the face 73 of which part can be screwed tight in three different positions against the rear face 80 of the housing 70. For this, two sets of three openings are provided in this face 80 disposed a distance from each other, the first set of three openings being indicated by 82, and the second set by 84. The face 73 of the closure part 76 which rests against the face 80 also has two sets of three openings, indicted by 90 and 92. Closure part 76 is fixed by means of fixing screws 94, always going through an opening of the set 82 and an opening of the set 90, or an opening of the set 84 and an opening of the set 92. By selection the openings, adaptation to the values $1_1$ and $1_2$ becomes possible.

The formation of the frame is thus limited to the selection of the combination of top strip and T-section 21 (standard parts), the selection of the bottom strip 6 (not a standard part) and the assembly of each end part 4*a*, 4*b* from housing 70 (standard part) and closure part 76 (standard part). This frame can then be fitted without grille unit; the grille unit to be used can then be fitted later on with a few simple manipulations.

What is claimed is:

1. A ventilation device comprising a rectangular frame having a barrier element and comprising a pair of spaced end parts to define sides of the frame, said frame further comprising a bottom side fitted between said end parts and shaped to receive an edge of a glass panel and an upper side fitted between said end parts, said upper side comprising a profiled strip which is L-shaped in cross-section and having a horizontal leg which is directed toward the room to be ventilated and an upright leg, said horizontal leg having a free end which merges into an upright edge which in turn merges into a first end edge directed towards said upright leg, a second end edge projecting at right angles from said upright leg toward said first end edge, said first and second end edges and said horizontal leg defining an accommodation space, and an inverted profiled T-section having a horizontal leg received within said accommodation space and further having an upright leg off set from the center of said horizontal leg.

2. A ventilation device as claimed in claim 1 and further comprising a second profiled strip parallel to said upper side profiled strip and having a portion defining a water barrier extending over at least a portion of the outside of the ventilation device, and means for connecting said upright leg of said upper side profiled strip to said second profiled strip.

3. A ventilation device as claimed in claim 2 wherein said connecting means comprises a thermal barrier.

4. A ventilation device as claimed in claim 2 wherein each said end part comprises a housing having an inner boundary edge directed toward the interior of the rectangular frame and an outside wall, said inner boundary edge being shaped to connect to the contour of said L-shaped upper side and said water barrier and to the outer-most end of said bottom side, said bottom side being substantially U-shaped and having an inner leg directed toward the room to be ventilated, an adjustable L-shaped shut-off part connected to said outside wall of said housing, there being a shut-off lip on one side of an upper or lower surface of said L-shaped shut-off part connected respectively to one of said upright leg of said profiled T-section and to said inner leg of said bottom side.

5. A ventilation device as claimed in claim 4 wherein said shut-off part has a face substantially parallel to said outside wall of said housing, said face of said shut-off part having two sets of at least three openings each disposed one above the other with a space there between, said outside wall of said housing having three pairs of screw take-up openings staggered horizontally and vertically with respect to each other.

6. A ventilation device as claimed in claim 1 wherein said end parts, bottom side and upper side of said rectangular frame define a space capable of accommodating a detachable independent structural component.

7. A ventilation device as claimed in claim 6 wherein said component comprises a sliding ventilation unit.

8. A ventilation device as claimed in claim 6 wherein said component comprises a rotary grill unit.

9. A ventilation device as claimed in claim 6 wherein said component comprises a valve grill unit.

* * * * *